US005807189A

United States Patent [19]

Martin et al.

[11] Patent Number: 5,807,189

[45] Date of Patent: Sep. 15, 1998

[54] GOLF CLUB HEAD

[75] Inventors: Richard L. Martin, Southbury; Steven Fisher, Redding; Andrew J. Carrano, Danbury, all of Conn.

[73] Assignee: Memry Corporation, Brookfield, Conn.

[21] Appl. No.: 568,654

[22] Filed: Dec. 7, 1995

[51] Int. Cl.[6] ..... A63B 53/04

[52] U.S. Cl. ..... 473/342; 473/331

[58] Field of Search ..... 473/342, 329, 473/330, 331, 332

[56] References Cited

U.S. PATENT DOCUMENTS

| | | | |
|---|---|---|---|
| 5,221,087 | 6/1993 | Fenton et al. | 473/342 |
| 5,433,440 | 7/1995 | Lin | 473/242 |

FOREIGN PATENT DOCUMENTS

| | | | |
|---|---|---|---|
| 0228875 | 12/1984 | Japan | 473/342 |

OTHER PUBLICATIONS

"Shape Memory Alloys", Metals Handbook, vol. 2, 10th Edition: Properties and Selection 1991.

"Advanced Materials to the Fore", S.K. Liu, Nov. 1993, MRS Bulletin.

*Primary Examiner*—George J. Marlo
*Attorney, Agent, or Firm*—Perkins, Smith & Cohen, LLP; Harvey Kaye, Esq.; Edwin H. Paul, Esq.

[57] ABSTRACT

A golf club ball-striking face (6) utilizing a metal with ten times or higher damping capacity compare to the steels presently in use for club faces. The metal has the strength near that of the steels. The preferred metal is of the class of shape memory metals of alloys including: copper, nickel, aluminum, and manganese. The face is an insert plate whose front ball striking surface is narrower than its rear surface and is secured into a cavity formed in the club head, where the plate may be as thin as 0.010 inches or the plate may extend to nearly the entire thickness of the club head.

1 Claim, 4 Drawing Sheets

ASSEMBLED

SWAGED

FINISHED

GOLF CLUB HEAD

FIELD OF THE INVENTION

The present invention relates generally to the material that forms the ball striking surface or face for golf clubs. More specifically, the present invention relates to inserts built into the face of golf clubs to provide better feel, better control and equal of better distance than the steel faces commonly used for golf club faces.

BACKGROUND OF THE INVENTION

Over the years there has been a search for golf clubs that hit the ball farther with more control and with more "feel". However, the ability to invent and apply new materials and technology to golf clubs has been limited by the golf rules as specified by the United States Golf Association (USGA). Within these rules, however, technology has entered the golf club world with inventive size and weight distribution of the club heads. But, recent changes in the USGA rules allow the use of different facing materials inserted into the body of the golf club head. The present invention is directed to this area of development.

Technical articles analyzing the performance of the face have suggested that the best materials were those having high elasticity and low damping capacity. One such article is a research report, entitled "Advanced Materials to the Fore", by S. K. Liu, published in the November 1993 issue of the MRS BULLETIN. In the third column of the first page, Liu states that "the characteristics needed for a club head material to produce greater ball velocity and flight distance are high elasticity and low damping capacity." Liu in his FIG. 3 lists twenty-four materials on a chart of material strength versus damping capacity. Liu discusses other important factors of elasticity, surface hardness and density (weight is controlled by the USGA golf rules), and Liu goes on the analyze composites, etc., but Liu predicts that the titanium alloys will be the popular choice for high performance club facings.

Among the twenty-four materials considered by Liu are metallic composites of manganese-copper, copper-aluminum-nickel, and copper-zinc-aluminum. These materials, according to Liu, would make poor golf club faces since these materials have high damping factors. In fact, these materials have higher damping factors than twenty of the other materials in Liu's analysis and these materials have about 200 plus times the damping capacity of the titanium materials favored by Liu.

Liu states that the high internal damping capacity would reduce the distance achieved since the energy stored in the club head as the face elastically deforms as the face impacts the ball will be absorbed in the club head (and not returned to the ball) due to this high internal damping capacity.

It is an object of the present invention to provide a golf club face material with high damping capacity that provides better "feel" and control without a significant loss of distance.

SUMMARY OF THE INVENTION

In accordance with the present invention a golf club face comprising a shape memory metal is employed, where the shape memory metal has from 10 to 250 times the damping capacity compared to the steels commonly used for club head face. In a preferred embodiment the shape memory metal is formed from the copper alloys including zinc, aluminum, manganese, and combination thereof, 40–50% nickel/titanium alloys with or without small additions, less than ten percent (10%), of other metals and other such known shape memory alloys. It was found that such materials provided advantages in the "feel" and control of the club when striking the ball without a substantial distance penalty. Indeed the distance was retained or even improved upon with clubs (irons) made in accordance with the present invention, especially the irons. It is well known that "feel" and control contribute to the accuracy and precision of the irons, and that distance achieved with the irons is of a much lower priority compared to the driver or the other "woods".

In a preferred embodiment a golf club head comprising a body and a shape memory metal insert constructed into said body to provide face. In a preferred embodiment the insert is a four sided plate, with a face and a back surface, with a bottom edge constructed to substantially follow the bottom edge of the club face, a top edge constructed to substantially follow the top edge of the club face, and where the two opposing side edges are beveled such that the insert face is narrower than the corresponding back surface, at least at some locations, and where the club head body has a cutout or pocket formed to accept the insert where the cutout has matingly beveled edges constructed to form an interference fit with the insert beveled edges such that the insert is retained in the cutout.

In another preferred embodiment the insert and cutout have matingly tongue and groove edges such that the insert is retained in the cutout.

In a preferred embodiment the two opposing side edges are wedge shaped or are closer to each other at the top of the club face than at the bottom of the club face.

In another preferred embodiment, the plate thickness may be thin and of non-uniform thickness. But, in another preferred embodiment, the plate extends to substantially the entire club head thickness—allowing for the construction integrity of the particular club head.

In any of these embodiments, the insert may be attached to the club head body with an adhesive and/or screws/rivets or braze.

Other objects, features and advantages will be apparent from the following detailed description of preferred embodiments thereof taken in conjunction with the accompanying drawings in which:

DETAILED DESCRIPTION OF PREFERRED EMBODIMENTS

Figure 1A:
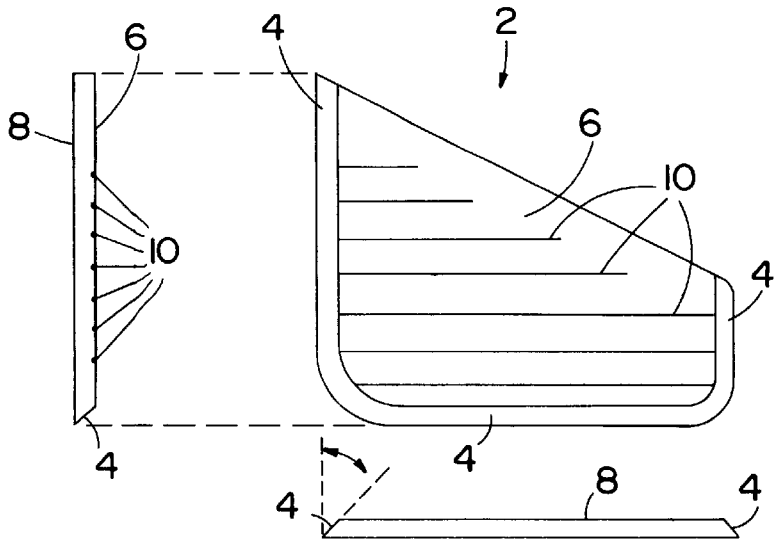
FIG. 1A is a front, side and bottom view of a bevelled edge insert made in accordance with the present invention for an iron.
Figure 1B:
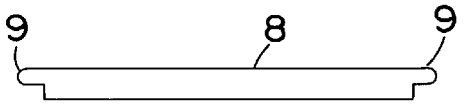
FIG. 1B is a bottom view of a tongue and goove edge insert made in accordance with the present invention for an iron.

FIG. 1A shows an insert 2 that substantially follows the contours of a golf club iron. The insert is beveled 4 on all sides except the top. The bevel 4 is directed such that the face 6 is narrower than the back 8 of the insert. The bevel is provided such that when the insert is mounted into the club head mating cutout or pocket, the insert will be retained securely in the club head even during the violent swings encountered while playing golf. The bevel is at 45 degrees and extends around the bottom and the two sides adjacent to the bottom edge. The insert is a plate of 0.90 to 0.93 inches thick. In other preferred embodiments the insert is 0.010 inches thick, and in other preferred embodiments the insert is thicker and not of uniform thickness. FIG. 1B shows anbother preferred embodiment of the insert. Here the tongue 9 is formed on each side of the insert to hold the insert in a corresponding groove in the club face.

The club face 6 has grooves 10 that provide traction when striking the ball and so impart spin to the ball. The grooves may be of any type approved by the USGA rules. A textured finish, rather than grooves, can be used and has been found to provide an effective alternative to grooves.

The spin is a desired occurrence to provide control of where the ball stops. This is very important when using the irons, even more especially when using the short irons (often considered, but not limited to the seven iron through the wedges). This spin allows the golfer to have the ball stop nearly where the ball lands and so the ball does not have to experience the unknown local landing conditions.

Figure 2A:
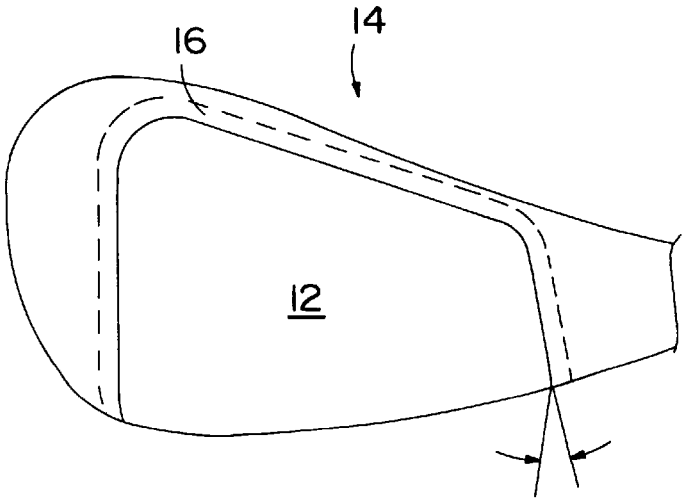
FIG. 2A is a front view of a club face with an insert

FIG. 2A shows a pocket 12 formed in the face of a club head 14. The pocket is formed from the bottom of the club head and extends upward. However, the pocket does not extend to the top edge of the club head—there remains a narrow channel 16 between the top of the pocket and the top of the club head. The insert is wedge shaped and the angle is preferably about 2°.

Figure 2B:
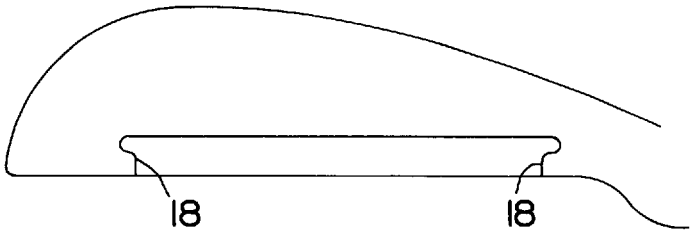
FIG. 2B is a bottom view of FIG. 2A showing the cut-out profile for the insert.

Referring to FIG. 2B the pocket has a grooved edge 18 that extends around the three sides (left, right and top) of the pocket. The groove 18 is arranged to matingly accept the tongue 9 of an insert. The insert will be secured within the club head by cement, epoxy or such cements as are known in the art. In another preferred embodiment the beveled edge of FIG. 1A is used.

Figure 3B:
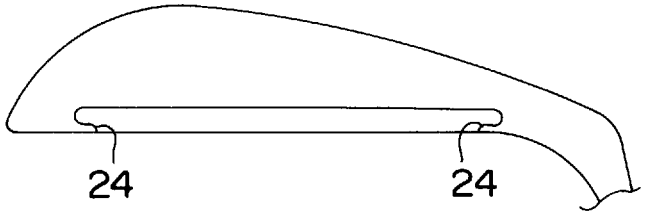
FIG. 3B is a top view showing the cut-out profile.
Figure 3A:
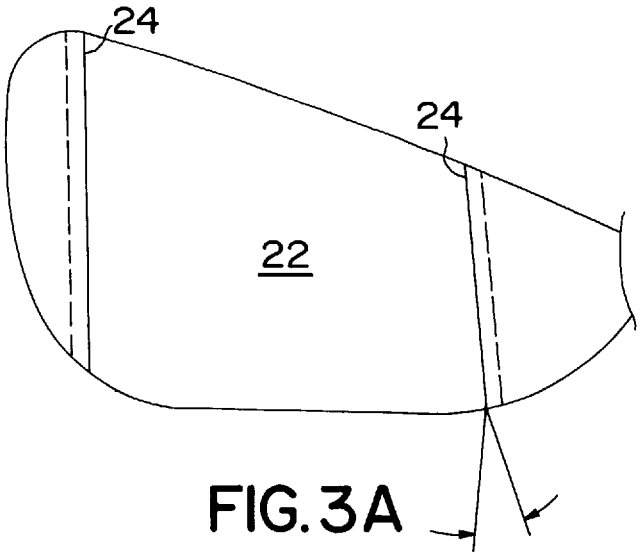
FIG. 3A is a front view of a club face with an insert of another preferred embodiment.
Figure 3C:
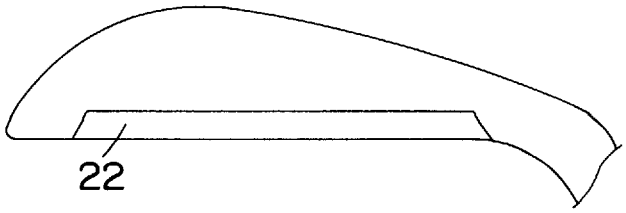
FIG. 3C is a top view similar to FIG. 3B but showing a different shaped cut-out.

FIG. 3A shows another club head 20 with a channel 22 that extends from the top to the bottom of the club head. In this instance, the insert forms part of the bottom and top edge of the club face. Grooved edges 24 retain the insert in the club head. The insert, from side to side, forms a wedge shape with the top edge slightly longer than the bottom edge—the angle shown is preferably about 2°. Other preferred embodiments may use other angles.

Other preferred embodiments, not shown, have the shape metal forming a sleeve permanently encasing the club head face where the shape metal forms substantially the entire club face. Yet other preferred embodiments have pockets that extend from the top of the club face down but not through the bottom of the club face.

In each of the preferred embodiments the shape metal is selected from copper alloys. Particular copper alloys are those including, aluminum, manganese and nickel, but other such metals are used in other preferred alloy embodiments. These metals are strong enough such that the faces are not permanently deformed by use, but these metals also provide a high internal damping with "feel" and control. Such damping capacities are from 10 to 300, and preferably from 100 to 200, times higher than the steels commonly used in golf club faces. Although Liu indicated that such high damping will limit the distance achieved with such a club face material it has been found that the distance is not limited, but in fact is often increased. It may be that such increases in distance is a result of the golfer's increased confidence due to the feel and control achieved with the present invention.

Figure 4:
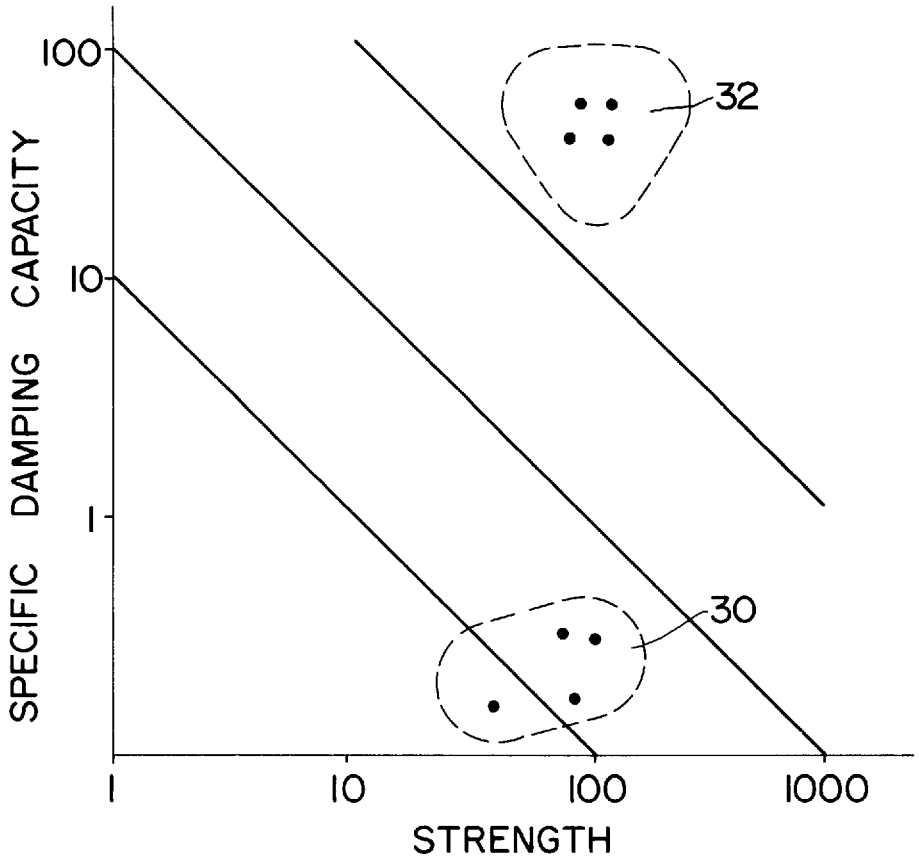
FIG. 4 is a graph of strength versus damping capacity of golf club face materials.

FIG. 4 is a graph of materials considered for golf club face materials. The strength and low damping materials are shown in the lower right areas 30. Metals with similar strength as those metals in area 30 but with 200 to 300 times higher damping capacity are shown in upper right area 32. These materials are the shape memory metals of the present invention, but other such metals with characteristics in this area may be used to advantage. However, the surface hardness, density, and modulus of elasticity must be factored into the use of such materials.

In this preferred embodiment the metals selected are from a class of metals called shape memory metals. Such metals demonstrate a martensitic transformation shape memory effect where the metal will "remember" and return to a former shape under certain known conditions. Such metals are well documented in the art.

Figure 5A:
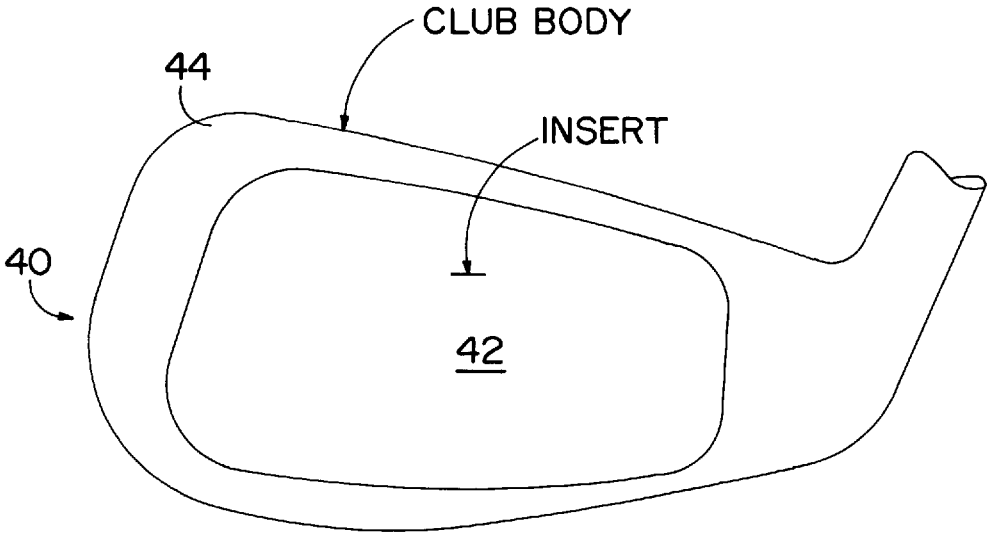
FIGS. 5A–D are views of another preferred embodiment.

FIG. 5A is a front view of a golf club face 40. An insert 42 covers the hitting area and the body of the club 44 forms a margin around the insert.

Figure 5B:
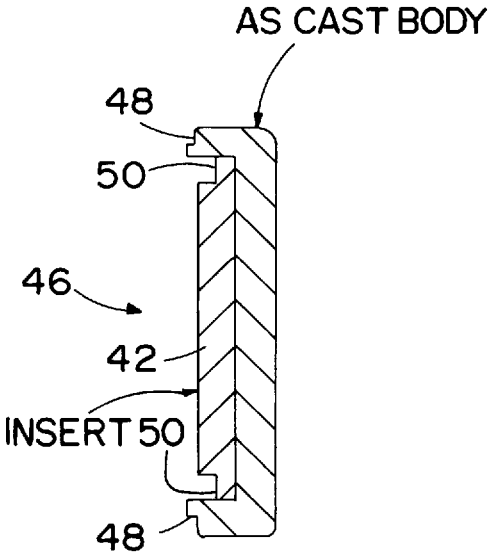
Figure 5C:
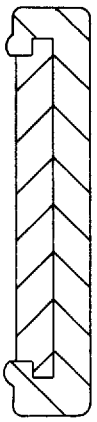
Figure 5D:
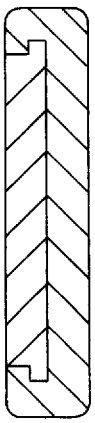

FIG. 5B shows the body 44 as a casting in a preferred embodiment, although forged and machined club bodies can be used. The body 44 has a cavity 46 into which the insert 42 is placed. Ears 48 extend out from the club face as shown and the inserts have grooves 50 designed to receive the ears. The ears are swaged over into the grooves as shown in FIG. 5C. The rough edges are finished to form a smooth club face as shown in FIG. 5D.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A golf club head comprising:

a body having an insert which provides the striking surface of the club head and is made of a material which includes a shape memory metal alloy of the type demonstrating a martensitic transformation shape memory effect and having a damping capacity of at least ten times that of stainless steel, the insert comprising a four sided plate, with a striking surface and a back surface, and having two opposing side edges which are beveled such that the insert striking surface is narrower than the corresponding back surface.

* * * * *